United States Patent [19]

Sofianek et al.

[11] Patent Number: 4,646,974

[45] Date of Patent: Mar. 3, 1987

[54] ELECTROMAGNETIC FUEL INJECTOR WITH ORIFICE DIRECTOR PLATE

[75] Inventors: Jay K. Sofianek; John F. Nally, both of Spencerport; James H. Rush, Pittsford; Robert L. Fuss, Rochester, all of N.Y.; John E. Williams, Waterford; Allan M. Ruckey, Pontiac, both of Mich.

[73] Assignee: General Motors Corporation, Detroit, Mich.

[21] Appl. No.: 730,462

[22] Filed: May 6, 1985

[51] Int. Cl.[4] ..... F02M 51/06

[52] U.S. Cl. ..... 239/585; 239/533.12; 239/590.3

[58] Field of Search ..... 239/533.12, 585, 590.3; 251/154

[56] References Cited

U.S. PATENT DOCUMENTS

| | | | |
|---|---|---|---|
| 4,218,021 | 8/1980 | Palma | 239/585 |
| 4,413,780 | 11/1983 | Skinner et al. | 239/533.4 |
| 4,423,842 | 1/1984 | Palma | 239/585 |
| 4,532,906 | 8/1985 | Hoppel | 239/533.12 |

*Primary Examiner*—Andres Kashnikow

*Attorney, Agent, or Firm*—Arthur N. Krein

[57] ABSTRACT

An electromagnetic fuel injector has an orifice director plate, mounted downstream of the orifice passage defined when the solenoid actuated valve of the injector is in the open position relative to its associated valve seat, for controlling static flow from the injector. The orifice director plate is provided with flow orifice passages that are axially downwardly inclined and radially inward extending so as to direct the jets of fuel flow, as desired, relative to the central axis of the orifice director plate and thus to the axis of the spray tip discharge passage of the injector.

8 Claims, 5 Drawing Figures

ELECTROMAGNETIC FUEL INJECTOR WITH ORIFICE DIRECTOR PLATE

FIELD OF THE INVENTION

This invention relates to electromagnetic fuel injectors and, in particular, to such an injector having a orifice director plate therein that is located downstream of the solenoid actuated valve of the injector assembly thereof.

DESCRIPTION OF THE PRIOR ART

Electromagnetic fuel injectors are used in fuel injection systems for vehicle engines because of the capability of this type injector to more effectively control the discharge of a precise metered quantity of fuel per unit of time to an engine. Such electromagnetic fuel injectors, as used in vehicle engines, are normally calibrated so as to inject a predetermined quantity of fuel per unit of time prior to their installation in the fuel system for a particular engine.

In one form of electromagnetic fuel injectors such as the type disclosed, for example, in U.S. Pat. No. 4,218,021 entitled "Electromagnetic Fuel Injector" issued Aug. 19, 1980 to James D. Palma, the flow discharge restriction in the nozzle assembly thereof is incorporated into a swirl director plate or disk having a plurality of director flow orifices passages thereof. In such an arrangement, the total flow area of these orifice passages is less than the flow area defined by a valve seat and an associate solenoid controlled valve when the valve is in a fully opened position. However, with the flow orifice arrangement in a swirl director plate as shown in this U.S. Pat. No. 4,218,021 although producing a hollow conical spray pattern, such spray patten has a relatively large cone angle of approximately 50° or larger with relative low flow energy of the fuel droplets. Accordingly when such a fuel injector is used, for example, in a port fuel injection system, the flowing air stream will tend to collapse such a large cone spray which can result in the reformation of large fuel droplets that can then wet the wall of the intake manifold. As a result thereof, a lean fuel mixture will then be supplied to the associate combustion chamber.

It is also known to use a single discharge flow orifice in order to produce a fuel discharge spray pattern in the form of a pencil stream for use, as an example, to deliver fuel directly onto the hot intake valve for a combustion chamber. However, it can be shown by statistical theory and by experimental results that multiple flow orifices in parallel flow relationship are superior in unit/unit flow repeatability to such a single flow orifice of comparable flow area.

It is also known that in order to obtain a solid pencil stream using such a single flow orifice that the single orifice passage must be relatively long or otherwise the stream will become fuzzy at its edges. Unfortunately, such a long orifice passage is functionally similar to a pipe and results in a relatively high pressure drop thereacross. Accordingly, with such a long single flow orifice passage, during a hot operating condition of the associate engine, some of the liquid fuel will vaporize thus affecting the actual fuel discharge from the injector, that is, it will then supply a lean fuel mixture.

SUMMARY OF THE INVENTION

Accordingly, a primary object of the present invention is to provide an improved electromagnetic fuel injector that advantageously has an orifice director plate incorporated therein downstream of the solenoid controlled valve thereof, and at right angles to the reciprocating axis of the valve, wherein each orifice in the director plate is inclined axially downward at a predetermined angle toward the reciprocating axis, whereby when the axes of the orifices are located so as to intersect the reciprocating axis the resulting spray pattern will be in the form of a pencil stream and when the axis of each flow orifice is angularly offset in one direction to a plane through the axis the resulting spray pattern will be in the form of a hollow cone of a relatively small angle.

Another object of this invention is to provide an improved electromagnetic fuel injector wherein an orifice director plate is located downstream of the solenoid controlled valve of the injector and at right angles to the reciprocating axis thereof, and wherein each of the plural orifices therethrough is angled axially downward and radially inward relative to the reciprocating axis so as to aim the fuel streams flowing through the orifice as desired so as to produce a discharge flow pattern either in the form of a pencil stream or in the form of a narrow hollow conical cone.

Still another object of this invention is to provide an injector apparatus of the above type which includes features of construction, operation and arrangement, rendering it easy to manufacture, asemble and to calibrate for desired fuel flow, which is reliable in operation, and in other respects suitable for use on production motor vehicle fuel systems.

The present invention provides an electromagnetic fuel injector having a housing with a solenoid stator means incorporated at one end thereof and an injection nozzle assembly incorporated at the opposite or discharge end thereof. An armature/valve member is reciprocable along a reciprocating axis relative to a pole piece of the stator means and an associate valve seat to control fuel flow to the injection nozzle assembly. The injection nozzle assembly includes an orifice director plate that is positioned at right angles to the reciprocating axis. Plural orifice passages are located concentrically about the reciprocating axis and each is angled axially downward and radially inward relative to this axis so as to aim the fuel streams at an angle to this axis. In one embodiment, the axis of each of the orifice passage is radially aligned with the reciprocating axis whereby the resulting flow jets from these orifice passages will form a pencil stream discharge flow pattern, while in an alternative embodiment, the axis of each of the orifice passages is angularly offset in one direction a predetermined amount relative to vertical planes passing through the reciprocating axis so that only portions of the separate jets discharged through the orifice passages will intersect each other at the reciprocating axis so as to produce a narrow, hollow, conical spray pattern.

For a better understanding of the invention, as well as other objects and features thereof, reference is had to the following detailed description of the invention to be read with the accompanying drawings.

DESCRIPTION OF THE EMBODIMENT

Figure 1:
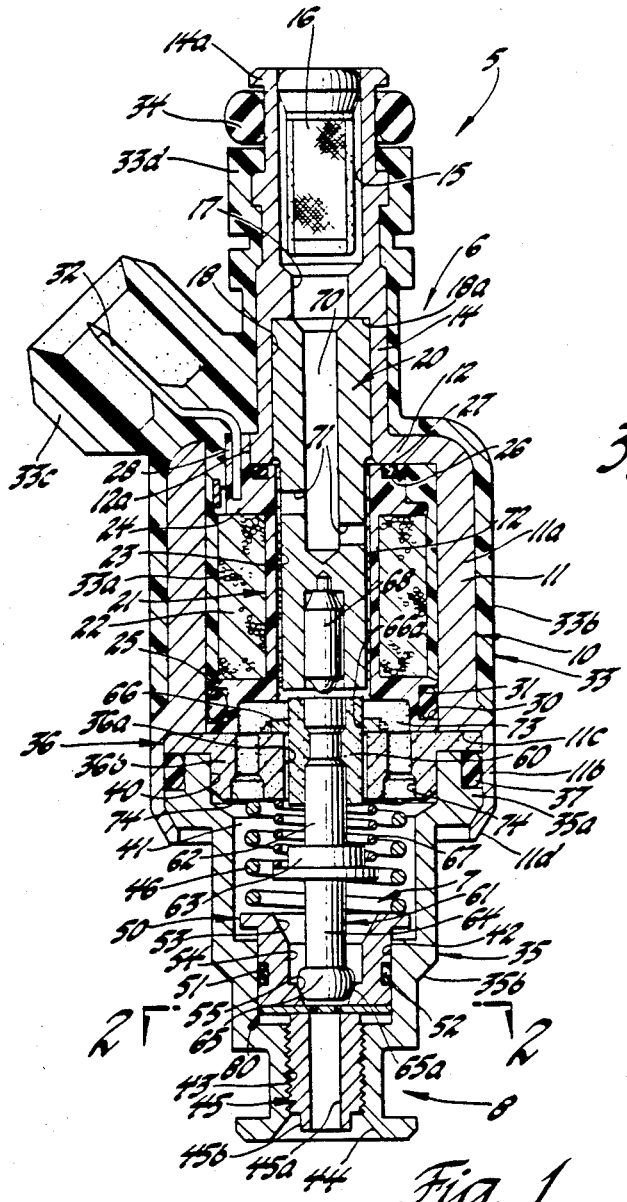
FIG. 1 is a longitudinal, cross-sectional view of an electromagnetic fuel injector with an orifice director plate in accordance with a preferred embodiment of the invention incorporation therein, the stop pin and valve member of the injector being shown in elevation.
Figure 2:
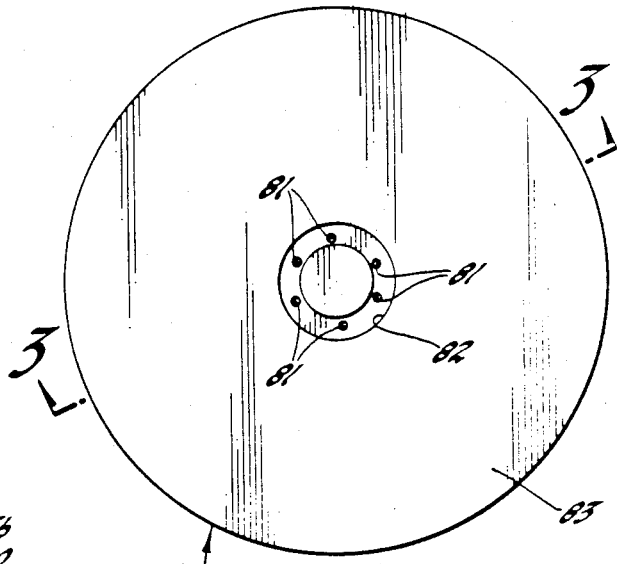
FIG. 2 is an enlarged top view of the orifice director plate, per se, of FIG. 1 taken along line 2—2 of FIG. 1.

Referring first to FIG. 1 there is illustrated an electromagnetic fuel injector, generally designated 5, with an orifice director plate in accordance with a preferred embodiment of the invention incorporated therein. The electromagnetic fuel injector 5 is of a type similar to that disclosed in U.S. Pat. No. 4,423,842 entitled "Electromagnetic Fuel Injector with Self Aligned Armature" issued Jan. 3, 1984 to James D. Palma, but having a top fuel inlet in lieu of the bottom feed shown in this U.S. Pat. No. 4,423,842, and the subject injector includes, as major components thereof, an upper solenoid stator assembly 6, an intermediate armature/valve member 7 and a lower nozzle assembly 8.

The solenoid stator assembly 6 includes a solenoid body 10 having a lower, rim-like, circular body 11, an integral flange portion 12 extending radially inward from the upper body 11 and terminating at an upstanding, tubular inlet tube portion 14. As shown, the body 11 includes an upper body portion 11*a* and a lower body portion 11*b*, the latter having both a greater internal diameter and outer diameter than the respective diameters of the upper portion and an interconnecting internal flat shoulder 11*c*. The upper portion 11*a* of body 11 is provided with a pair of opposed radial ports, not shown, for a purpose to be described hereinafter. Also as shown, the flange 12 is provided with an arcuate opening 12*a* for a purpose to be described hereinafter.

The inlet tube portion 14 of the solenoid body 10 at its upper end, with reference to FIG. 1, is adapted to be suitably connected, as by a fuel rail to a source of low pressure fuel and is provided with a stepped bore that extends axially therethrough so as to define, starting from its upper end an inlet fuel chamber 15 having a fuel filter 16 mounted therein, an axial inlet passage 17, and a pole piece receiving bore wall 18 of a predetermined internal diameter to receive, as by a press fit, the upper enlarged diameter end portion of a stepped diameter pole piece 20 with the upper end of this pole piece being located so that it will abut against the internal shoulder 18*a* of the inlet tube portion 14.

The solenoid stator assembly 6 further includes a spool-like, tubular bobbin 21 supporting a wound wire solenoid coil 22. The bobbin 21, made, for example, of a suitabe plastic material such as glass filled nylon, is provided with a central through bore 23, of a diameter so as to loosely encircle the lower reduced diameter end of the pole piece 20, and with upper and lower flange portions 24 and 25 respectively.

The upper flange 24, in the construction shown, is of stepped external configuration as shown in FIG. 1 and is provided with an annular groove 26 in its upper surface to receive a seal ring 27 for sealing engagement with the lower surface of the flange 12 and tube portion 14, and radially outboard of the groove 26 with an upstanding boss 28 that projects up through the arcuate opening 12*a* in the flange 12. The bottom flange 25 is provided with an annular groove 30 in its outer peripheral surface to receive a seal ring 31 for sealing engagement with the internal surface of the upper body portion 11*a*.

A pair of terminal leads 32, only one being shown in FIG. 1, are each operatively connected at one end to the solenoid coil 22 and each such lead has its other end extending up through the boss 28 for connection to a suitable controlled source of electrical power, as desired, in a manner well known in the art.

Preferably, the axial extent of bobbin 21 is preselected relative to the internal axial extent of the upper body portion 11*a* of the solenoid housing 10 between the lower surface of flange 12 and the shoulder 11*c* so that when the bobbin 21 is positioned in the solenoid housing 10, as shown in FIG. 1; an axial clearance will exist between the lower face of the bottom flange 25 of the bobbin 21 and the shoulder 11*c* of the solenoid housing 10, for a purpose to become apparent hereinafter.

Bobbin 21 is supported within the solenoid housing 10 by means of an encapsulant member 33, made of a suitable encapsulant material, such as glass filled nylon, that includes a cylindrical portion 33*a* encircling the solenoid coil 22 and the outer peripheral edge of the upper flange 24 of the bobbin 21 and which is also in abutment against the inner surface of the upper body portion 11*a* of body 11, a plurality of radial or axial extending bridge connectors, not shown, corresponding in number to the apertures, not shown, in the upper body portion, an outer cup-shaped outer shell 33*b* encircling the exterior upper portion 11*a* of body 11, and covering the exterior of flange 12 of the solenoid body 10, a stud 33*c* partly enclosing the terminal leads 32 and, a cylindrical portion 33*d* which encircles the inlet tube portion 14 with the upper surface of this latter portion terminating in spaced relationship to the lower surface of the flange 14*a* of the inlet tube portion 14 so as to, in effect, form therewith an annular groove for an O-ring seal 34.

The nozzle assembly 8 includes a nozzle body 35 of tubular configuration having a stepped upper flange 35*a* with an externally stepped lower body 35*b* of reduced external diameter depending therefrom.

The nozzle body 35 is fixed to the solenoid housing 10, with a separate stepped spacer disk 36 sandwiched between the upper surface of the nozzle body 35 and the shoulder 11*c*, as by inwardly crimping or swaging the lower end of the body portion 11*b* to define a radially inwarding extending rim flange 11*d*. Since, as previously described, the axial extent of bobbin 21 is preselected to provide an axial clearance between the lower surface of its flange 25 and shoulder 11*c*, the spacer disk 36 will abut against this shoulder. Also as shown, the upper flange 35*a* is undercut so as to define a groove to receive a seal ring 37 to effect a sealed connection between the nozzle body 35 and the internal wall of the lower body portion 11*b*.

Nozzle body 35 is provided with a central stepped bore to provide a circular, internal upper wall 40 of a diameter to slidably receive the depending hub portion 36*b* of the spacer disk 36, an intermediate upper wall defining a spring/fuel supply cavity 41, an intermediate lower wall defining a valve seat receiving cavity 42, a lower internally threaded wall 43 terminating in a radially outward flared discharge wall 44.

The nozzle assembly 8 further includes a tubular spray tip 45, having an axial discharge passage 45*a* therethrough, that is adjustable threaded into the internally threaded wall 43 of the nozzle body 35, suitable opposed flats 45*b* being provided on the outlet end of the spray tip to effect rotation thereof, as by a suitable wrench. At its upper end, the spray tip 45 axially supports a thin orifice director plate, designated 80, in accordance with a preferred embodiment of the invention to be described in detail hereinafter, which is loosely received in the cavity 42.

Figure 3:
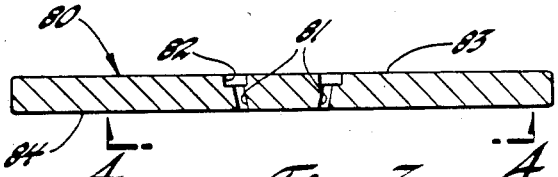
FIG. 3 is an enlarged cross-sectional view of the orifice director plate per se, taken along line 3—3 of FIG. 2.

The orifice director plate 80 is held in abutment against the upper end of the spray tip 45 by means of a valve seat element 50, also loosely received in the cavity 42 and which is normally biased in an axial direction toward the spray tip 45, downward with reference to FIGS. 1 and 3, by a coiled spring 46, one end of which abuts against the valve seat element 50 while its opposite end abuts against the spacer disk 36.

Preferably as shown, the valve seat element 50 is provided with an annular groove 51 about its reduced diameter outer peripheral surface to receive a ring seal 52 that sealingly abuts against the wall 42. The valve seat element 50 is also provided with a stepped axial bored passage defined by an upper radially inward inclined wall 53, a straight intermediate wall 54 terminating in a radially inward inclined wall defining an annular frusto-conical valve seat 55.

Referring now to the armature valve member 7, it includes a tubular armature 60 and a valve element 61, made for example of stainless steel, that includes a stepped upper shank 62, an intermediate radial stepped flange 63 with a shank 64 depending therefrom that terminates at a valve 65 which is of semi-spherical configuration and of a predetermined radius with its lower truncated end portion defining a valve seating surface 65*a* for seating engagement with the valve seat 55. The armature 60 is suitably fixed to the upper shank 62 of the valve element, as by being crimped thereon, and is formed with a predetermined outside diameter so as to be loosely slidable through the central bored aperture 36*a* provided in the spacer disk 36.

The armature 60 is guided for axial movement by means of a guide washer 66, having a guide bore wall 66*a* of predetermined internal diameter, that is fixed, as by welding, to the spacer disk 36 concentrically around the aperture 36*a* therethrough.

The valve 65 of valve element 61 is normally biased into seating engagement with the valve seat 55 by a valve return spring 67 of predetermined force which loosely encircles the upper shank of the valve element. As shown, one end of the valve return spring 67 is centered by and abuts against the flange 63 of the valve element 61 while its opposite end abuts against the lower surface of the spacer disk 36.

The axial extent of the armature/valve member 7 is preselected such that when the valve 65 is seated against the valve seat 55, a predetermined working air gap exists between the opposed working surfaces of the armature 60 and the pole piece 20. However, a fixed minimum working air gap between these opposed working surfaces is maintained by means of a stop pin 68 suitably fixed, as by a press fit, into a blind bore provided in the lower end of the pole piece 20, with the lower end of the stop pin 68 extending a predetermined axial distance downward from the lower working surface of the pole piece 20 whereby to engage the armature/valve member 7 during opening movement thereof to thus limit its upward travel in a valve open position.

The pole piece 20, as shown in FIG. 1, is also provided with a blind bore defining an inlet passage portion 70 which at one end is in flow communication with the inlet passage 17 and which adjacent to its other or lower end is in flow communication via radial ports 71 with an annulus fuel cavity 72 formed by the diametrical clearance between the reduced diameter lower end of the pole piece 20 and the bore wall 23 of bobbin 21. Fuel cavity 72 is, in turn, in flow communication with the annular recessed cavity 73 provided in the lower flange 25 end of the bobbin 21 and via through passages 74 in the spacer disk 36 located radially outward of the guide washer 66 with the spring/fuel cavity 41.

Referring now to the subject matter of this invention, the orifice director plate 80, made of a suitable material such as stainless steel, in accordance with the preferred embodiment shown in FIG. 1–4, is of circular configuration and with a central axis, which axis, as this director plate 80 is mounted in the injector 5, is substantially coaxial with the reciprocating axis of the armature/valve member 7. Located about a bolt circle of predetermined diameter positioned concentric to the central axis of this director plate 80 are a plurality of circumferentially, equally spaced apart axially inclined and radial inward extending through flow orifice or passages 81 of predetermined diameter, six such flow orifices being used in the construction shown. These flow orifices passages 81 extend from an annular groove 82 formed in the upper or upstream surface 83, in terms of the direction of fuel flow, of the director plate 80 to open through the bottom or downstream surface 84 thereof. As best seen in FIG. 1, the outside diameter of the groove 82 is preferably less than or equal to the internal diameter of the valve seat 55 at the lower or downstream end thereof. Accordingly, it should now be apparent that the bolt circle about which the orifice passages 81 are formed is preselected so as to be less than the outside diameter of groove 82.

Figure 4:
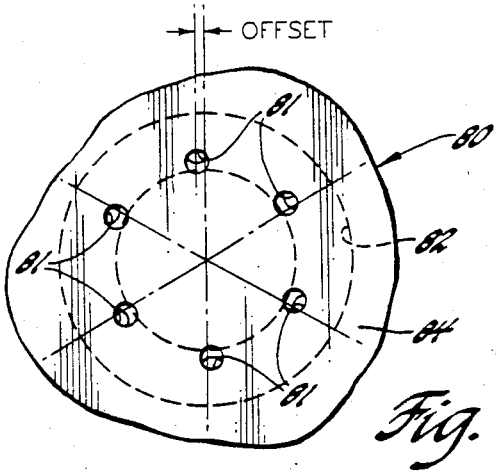
FIG. 4 is an enlarged view of the bottom orifice passage portion of the orifice director plate, per se, of FIG. 2; and, FIG. 5 is an enlarged view, similar to that of FIG. 4, of the orifice portion of an alternate embodiment orifice director plate in accordance with the invention wherein the flow orifice passages are located so as to produce a pencil stream fuel discharge spray pattern.

Now in accordance with a feature of the invention and with reference to the embodiment shown in FIGS. 1–4, in order to produce a narrow hollow conical spray pattern having a predetermined included angle, for example, of about 10° to 20°, the central axis of each of the flow orifice passages 81 is inclined at a predetermined angle relative to the central axis of the orifice director plate and each such passage axis is angularly located a predetermined distance either in a counterclockwise direction, as shown and as best seen in FIG. 4, or in a clockwise direction relative to respective vertical planes intersecting the central axis of the orifice director plate 80.

Thus with this arrangement a narrow cone spray will be produced by directing the fuel jet spray streams discharged from each flow orifice passage so that approximately up to one half of each such spray stream will intersect or impinge against each other at a point area at the central axis. The angle of such a narrow cone spray can be varied, as desired, by varying how much of the spray stream from each flow orifice passage that intersects, that is, by varying the angular offset of the axis of these passages, as desired, to the respective vertical planes intersecting the central axis, and the inclined angle of these flow orifice passages 81. Increasing the orifice angle or increasing the angular offset will increase the angle of the spray cone. As should now be apparent from the illustration shown in FIG. 4, the angular offset of each spray orifice passage axis can be increased up to approximately one half of the spray orifice diameter because beyond that dimension the spray streams would no longer intersect and would then merely result in individual angled spray streams.

The effect of the spray jet streams on each other can best be explained with reference to the diametrical opposed flow orifice passage arrangement illustrated in FIG. 4. As shown, an opposed pair of flow orifice passages are angled toward the central axis of the orifice director plate 80 with the axes of these orifice passages offset counterclockwise angularly to a common vertical plane intersecting the central axis. The individual spray streams exit from the diametrically opposed orifice passages 81 and partly intersect or impinge against each other in the area of the central axis. Thus at this point, a portion of the spray streams will intersect with each other while the remaining portion of each stream will bend slightly or not be affected at all depending on surface tension of the fuel and the amount of angular offset. This will produce a hollow spray cone angle that is equal or less than the orifice passage angle and atomizes the fuel to form a narrow conical spray pattern.

Figure 5:
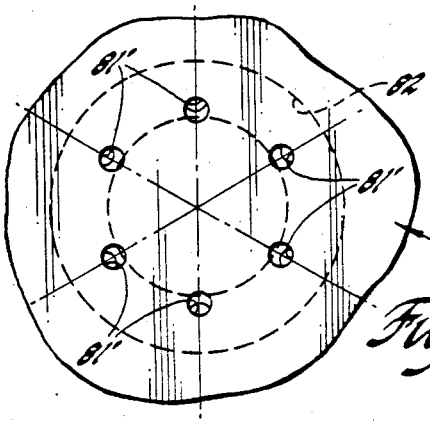

An alternate embodiment of an orifice director plate, generally designated 80', in accordance with the invention is shown in FIG. 5 wherein similar parts are designated by similar numerals but with the addition of a prime (') where appropriate.

In this alternate embodiment, the orifice director plate 80' is also provided with multiple flow orifice passages 81' of predetermined diameter that extend from an annular groove 82 provided in the upstream surface of this director plate, six such orifice passages being used in the construction illustrated in FIG. 5. As shown, the orifice passages 81 are located on a bolt circle of predetermined diameter less than the internal diameter of the valve seat 55 at the lower or downstream end thereof, and concentric to the central axis of the director plate. As in the preferred embodiment, these orifice passages 81' are axially downwardly inclined and are radially inward extending. However in the FIG. 5 embodiment, the axis of each orifice passage 81' is located so that an extension thereof will intersect an extension of the central axis of the director plate 80' downstream, in terms of the direction of fuel flow, of this director plate so that the separate jet spray streams from these orifice passages will fully intersect each other in the area of the central axis so as to produce a solid pencil stream fuel discharge spray pattern.

The number of flow orifice passages 81 and 81' and the diameter thereof are preselected, as desired for a given engine application, whereby the total cross-sectional flow orifice passage area is substantially less than the flow areas upstream and downstream thereof, including the upstream flow area defined between the valve seat 55 and valve 65 when the latter is in a full open position relative to valve seat 55.

In addition, the internal diameter of the discharge passage **45*a* and the axial extent thereof in the spray tip 45 are preselected, as desired, especially when used with the orifice director plate 80 of the FIGS. 1–4 embodiment, whereby the desired spray pattern, the narrow conical spray pattern in the FIG. 1–4 embodiment, can be produced therein without wetting the wall of this discharge passage 45*a***.

While the invention has been described with reference to the structures disclosed herein, it is not confined to the specific details set forth, since it is apparent that modifications and changes can be made by those skilled in the art. This application is therefore intended to cover such modifications or changes as may come within the purposes of the improvements or scope of the following claims.

The embodiments of the invention in which an exclusive property or privilege is claimed are defined as follows:

1. An orifice director plate for use in an electromagnetic fuel injector of the type used to discharge fuel into the combustion chambers of an internal combustion engine, said orifice director plate being of circular configuration with an upstream surface and an opposed downstream surface and with a central axis, a plurality of equally spaced apart through orifice passages located on a circumference of a base circle positioned concentric to said central axis, the axis of each said orifice passage being inclined downward at an angle to said central axis and extending radially inward from the upstream to the downstream ends of said orifice passage so that each said orifice passage will direct a stream of fuel downstream toward said central axis whereby the said streams from said orifice passages will thus at least partly impinge upon each other so as to produce a total combined fuel spray pattern.

2. An orifice director plate according to claim 1 wherein the axis of each said orifice passages is located parallel to and angularly spaced from respective planes extending through said central axis a distance less than one-half the diameter of said orifice passages whereby the streams of fuel from said orifice passages will partly intersect each other and combine so as to form a hollow, narrow conical spray pattern.

3. An orifice director according to claim 1 wherein the axis of each said orifice passages is located so as to intersect said central axis whereby the streams of fuel from said orifice passages will intersect each other and combine so as to form a pencil stream spray pattern.

4. An orifice director plate for use in an electromagnetic fuel injector of the type used to discharge fuel into the combustion chambers of an internal combustion engine, said orifice director plate being of circular configuration with opposed surfaces and with a central axis, a plurality of circumferentially equally spaced apart through orifice passages located on a circumference of a base circle positioned concentric to said central axis, the axis of each said orifice passage being inclined at an angle to said central axis and located parallel to but angularly spaced from respective planes extending through said central axis whereby each said orifice passage will direct a stream of fuel so that only a portion of said stream will intersect said central axis whereby the said streams from said orifice passages will thus partly impinge upon each other so as to produce a hollow, narrow conical fuel spray pattern with the fuel droplets therein flowing in a spiral circumferential direction.

5. A fuel orifice director plate for use in an electromagnetic fuel injector of the type used to discharge fuel to the combustion chambers of an internal combustion engine, said orifice director plate being of circular configuration with opposed upstream and downstream surfaces in terms of the direction of fuel flow and with a central axis, a plurality of circumferentially equally spaced apart through orifice passages located on a circumference of a base circle positioned concentric to said central axis, the axis of each said orifice passage being inclined axially downward from said upstream surface toward said downstream surface at an angle to said central axis and radially extending toward said central axis, the axis of each of said orifice passages aligned to intersect said central axis whereby each said orifice passage will direct streams of fuel that intersect with each other at said central axis whereby the said streams from said orifice passages will thus impinge upon each other so as to produce a pencil like fuel spray pattern.

6. An orifice director plate for use in an electromagnetic fuel injector of the type used in the fuel injection system for an internal combustion engine, said orifice discharge plate including a disk in the form of a body of revolution about an axis and of a predetermined thickness and having opposed surfaces, a plurality of equally spaced apart, circular, through orifice passages located on a circumference of a base circle positioned concentric to said axis with each such orifice passage being inclined axially downward at a predetermined angle to said axis and extending radially inward toward said axis whereby the streams of fuel discharged from said orifice passages will at least partly impinge upon each other so as to produce a discharge fuel spray pattern.

7. An orifice director plate according to claim 6 wherein the axis of each said orifice passages is located parallel to and angularly spaced from respective planes extending through said central axis a distance less than one-half the diameter of said orifice passages whereby the streams of fuel from said orifice passages will partly intersect each other and combine so as to form a hollow, narrow conical spray pattern.

8. An orifice director according to claim 6 wherein the axis of each said orifice passages is located so as to intersect said central axis whereby the streams of fuel from said orifice passages will intersect each other and combine so as to form a pencil stream spray pattern.

* * * * *